US008360172B2

(12) United States Patent
Santelmann

(10) Patent No.: US 8,360,172 B2
(45) Date of Patent: Jan. 29, 2013

(54) STEERING DEVICE FOR DOWNHOLE TOOLS

(75) Inventor: Bernd Santelmann, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 443 days.

(21) Appl. No.: 12/423,439

(22) Filed: Apr. 14, 2009

(65) Prior Publication Data

US 2009/0260884 A1 Oct. 22, 2009

Related U.S. Application Data

(60) Provisional application No. 61/045,478, filed on Apr. 16, 2008.

(51) Int. Cl.
*E21B 7/04* (2006.01)

(52) U.S. Cl. ..... 175/61; 175/74; 175/76; 166/117.5; 166/117.7

(58) Field of Classification Search ..... 175/61, 175/74, 76, 98, 99, 256, 101, 62, 50, 73, 175/75, 43, 26, 40, 27; 166/117.5, 117.7
See application file for complete search history.

(56) References Cited

U.S. PATENT DOCUMENTS

| | | | | |
|---|---|---|---|---|
| 4,303,135 | A * | 12/1981 | Benoit | 175/73 |
| 5,050,692 | A * | 9/1991 | Beimgraben | 175/61 |
| 5,113,953 | A * | 5/1992 | Noble | 175/61 |
| 5,343,967 | A * | 9/1994 | Kruger et al. | 175/75 |
| 5,368,111 | A | 11/1994 | Benoit et al. | |
| 5,458,208 | A * | 10/1995 | Clarke | 175/45 |
| 5,535,835 | A * | 7/1996 | Walker | 175/73 |
| 5,542,482 | A * | 8/1996 | Eddison | 175/61 |
| 5,575,343 | A * | 11/1996 | Gray | 175/61 |
| 5,875,859 | A * | 3/1999 | Ikeda et al. | 175/73 |
| 6,092,610 | A * | 7/2000 | Kosmala et al. | 175/61 |
| 6,446,737 | B1 | 9/2002 | Fontana et al. | |
| 6,659,201 | B2 * | 12/2003 | Head et al. | 175/61 |
| 6,808,027 | B2 * | 10/2004 | McLoughlin et al. | 175/24 |
| 7,195,083 | B2 * | 3/2007 | Eppink et al. | 175/61 |
| 7,287,604 | B2 * | 10/2007 | Aronstam et al. | 175/61 |
| 7,588,082 | B2 * | 9/2009 | Lasater | 166/255.1 |
| 7,735,581 | B2 * | 6/2010 | Beylotte et al. | 175/101 |
| 2003/0034178 | A1 * | 2/2003 | Cargill et al. | 175/73 |
| 2003/0146022 | A1 * | 8/2003 | Krueger | 175/61 |

(Continued)

FOREIGN PATENT DOCUMENTS

| | | | |
|---|---|---|---|
| DE | 4015300 C | * | 1/1992 |
| GB | 2307537 A | * | 5/1997 |

OTHER PUBLICATIONS

Brake. 2011. In Merriam-Webster Online Dictionary. Retrieved Feb. 28, 2011, from http://www.merriam-webster.com/dictionary/brake?show=4&t=1298982666.*

*Primary Examiner* — Matthew Buck
(74) *Attorney, Agent, or Firm* — Cantor & Colburn LLP

(57) ABSTRACT

An apparatus for drilling a wellbore may include a first section, a second section, and a third section, all of which are rotatably interconnected with pivot bearings and positioned along a drill string. The second section and the third section may be configured to form a controllable bend angle in the drill string. The first section, the second section, and the third section may be configured as sleeves that surround a portion of the drill string. One or more sections may include locking pads that selectively engage a wall of the wellbore. A hydraulic locking device for controlling a direction of rotation of the second section may include one or more brake elements and a reverse spinning sleeve. A first brake element may be used engage the reverse spinning sleeve and a second brake element may be used to engage a drive shaft.

21 Claims, 4 Drawing Sheets

U.S. PATENT DOCUMENTS

2004/0231893 A1* 11/2004 Kent ..... 175/74
2009/0183921 A1* 7/2009 Gurjar et al. ..... 175/61
2009/0205867 A1* 8/2009 Reckmann et al. ..... 175/24
2009/0272578 A1* 11/2009 MacDonald ..... 175/26

* cited by examiner

STEERING DEVICE FOR DOWNHOLE TOOLS

CROSS-REFERENCE TO RELATED APPLICATIONS

This application takes priority from U.S. Provisional Application Ser. No. 61/045,478 filed Apr. 16, 2008.

BACKGROUND OF THE DISCLOSURE

1. Field of the Disclosure

This disclosure relates generally to oilfield downhole tools and more particularly to modular drilling assemblies utilized for directionally drilling wellbores.

2. Description of the Related Art

To obtain hydrocarbons such as oil and gas, boreholes or wellbores are drilled by rotating a drill bit attached to the bottom of a drilling assembly (also referred to herein as a "Bottom Hole Assembly" or "BHA"). The drilling assembly is attached to the bottom of a tubing, which is usually either a jointed rigid pipe or a relatively flexible spoolable tubing commonly referred to in the art as "coiled tubing." The string, which includes the tubing and the drilling assembly, is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore. The mud motor is rotated by the drilling fluid passing through the drilling assembly. A drive shaft connected to the motor and the drill bit rotates the drill bit.

A substantial proportion of current drilling activity involves drilling deviated and horizontal wellbores to more fully exploit hydrocarbon reservoirs. Such boreholes can have relatively complex well profiles. To drill such complex boreholes, some drilling assemblies utilize a plurality of independently operable pads to apply force on the wellbore wall during drilling of the wellbore to maintain the drill bit along a prescribed path and to alter the drilling direction. For rotating drill stings, such pads may be positioned on a non-rotating sleeve disposed around the rotating drive shaft. These pads are moved radially to apply force on the wellbore in order to guide the drill bit and/or to change the drilling direction outward by electrical devices or electro-hydraulic devices.

The present disclosure addresses the certain other apparatus and methods for steering a drill bit.

SUMMARY OF THE DISCLOSURE

In aspects, the present disclosure provides an apparatus conveyed via a drill string configured to form a wellbore in an earthen formation. The apparatus may include a first section positioned along the drill string; a second section coupled to the first section; and a third section rotatably coupled to the second section. The second section may be selectively rotated relative to the first section. Also, the second section and the third section may be configured to form a controllable bend angle in the drill string. In embodiments, the first section, the second section and the third section may be configured as sleeves that surround a portion of the drill string. In aspects, the first section, the second section and the third section may be configured to be rotatably mounted on the drill string. In configurations, the first section and the third section may include at least one anchoring element or pad that is configured to engage a wall of the wellbore. In arrangements, a hydraulic locking device may be used to control a direction of rotation of the second section. The hydraulic locking device may include one or more brake elements and a reverse spinning sleeve. A first brake element may be used to engage the reverse spinning sleeve and a second brake element may be used to engage a drive shaft. In embodiments, a pivot bearing connects one or both of: the first section to the second section, and the second section to the third section. The pivot bearing may be configured to selectively lock adjoining sections.

In aspects, the present disclosure provides a method for forming a wellbore in an earthen formation. The method may include positioning a first section, a second section, and a third section on a drill string; rotatably coupling the first section to the second section; rotatably coupling the second section to the third section; conveying the drill string into the wellbore; and rotating the second section relative to the third section to form a controllable bend angle in the drill string.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1A:
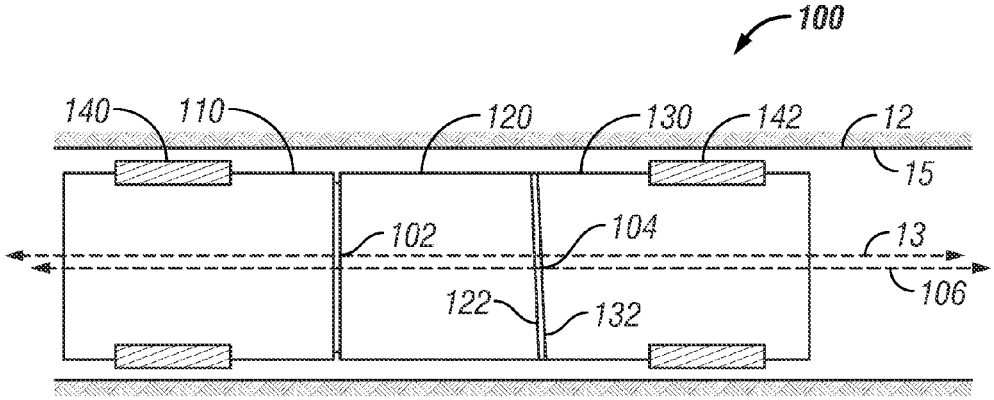
FIGS. 1A-C schematically illustrate an operation of a steering device made in accordance with one embodiment of the present disclosure.

The present disclosure relates to devices and methods for directional drilling of wellbores. The present disclosure is susceptible to embodiments of different forms. There are shown in the drawings, and herein will be described in detail, specific embodiments of the present disclosure with the understanding that the present disclosure is to be considered an exemplification of the principles of the disclosure, and is not intended to limit the disclosure to that illustrated and described herein. Further, while embodiments may be described as having one or more features or a combination of two or more features, such a feature or a combination of features should not be construed as essential unless expressly stated as essential.

Figure 1B:
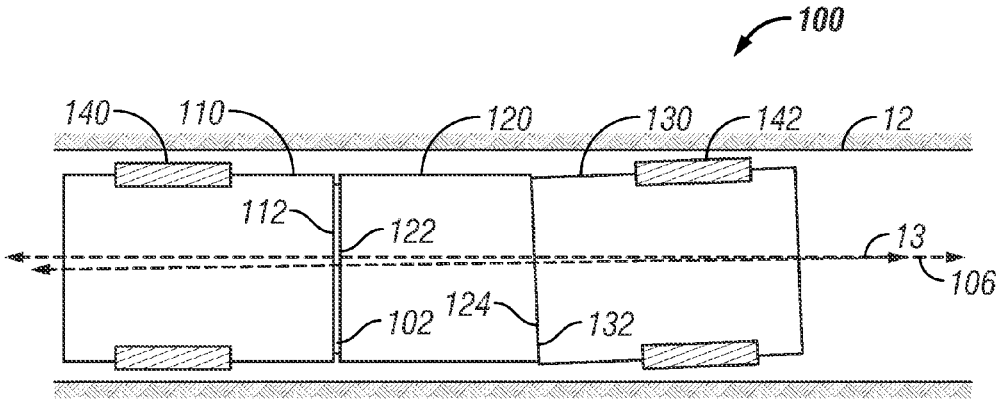
Figure 1C:
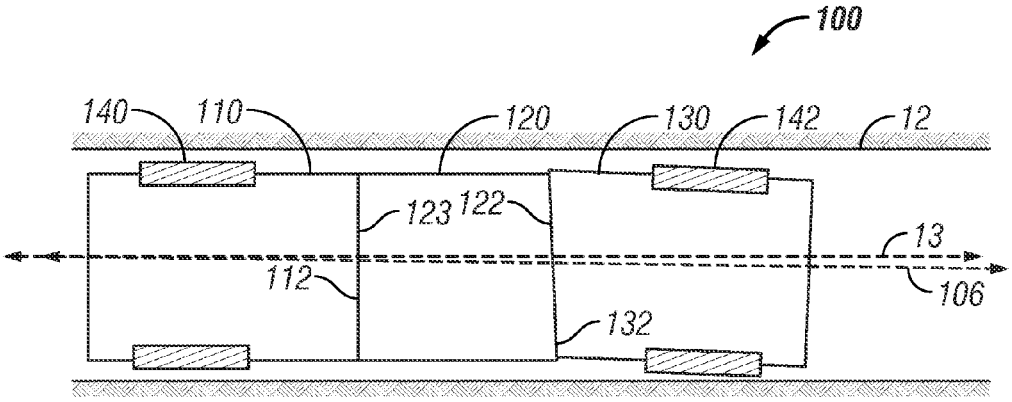

Referring now to FIGS. 1A-1C, there is schematically illustrated a steering unit 100 that incorporates aspects of the present teachings. As will be described in greater detail below, the steering unit 100 points a drill bit in a selected drilling direction by bending a section of the steering unit 100. The bend, which may be on the order of a one degree to a ten or more degree angle relative to a long axis 13 of a wellbore, can be rotated as needed to obtain a desired direction according to a selected reference frame or orientation (e.g., azimuthal direction, gravity tool face, etc.). The steering unit 100 may include a first or upper section 110, a second or middle section 120 and a third or lower section 130. The upper section 110 may include adjustable pads 140 that lock the upper section 110 into engagement with a wall 15 of the wellbore 12. The lower section 130 may also include pads 142. The pads 140, 142 may be fixed or adjustable.

A pivot bearing 102 separates the upper section 110 from the middle section 120 and a pivot bearing 104 separates the middle section 120 from the lower section 130. Each pivot bearing 102, 104 allows their respective adjacent sections to selectively rotate relative to one another. The pivot bearings 102, 104 may include internal devices that may allow such selective interlocking. The pivot bearing 102 allows relative rotation between the upper section 110 and the middle section 120, which controls the direction of drilling by controlling the direction (e.g., azimuth, inclination, gravity) in which the drill bit (not shown) is pointing. The pivot bearings 102, 104 may also be used to compensate for undesirable sleeve rotation due to friction. The pivot bearing 104 allows relative rotation between the middle section 120 and the lower section 130, which controls the magnitude of tilt or angular bend in the steering device 100.

Referring to FIG. 1A, the steering device 100 is shown in a "straight ahead" drilling mode. The middle section 120 and the lower section 130 have end faces 122 and 132 respectively that incorporate a tilt of the same angle. The tilt is relative to a plane perpendicular to the axial tool line 106. As shown, the end faces 122 and 132 have the slope of their respective tilts in the same direction, which has the effect of canceling their relative tilts. Thus, the axial centerline 106 of the steering device 100 is generally parallel with a centerline 13 of the wellbore 12.

Referring to FIG. 1B, the steering device 100 is shown in a directional drilling mode of operation. Upper section 110 and middle section 120 have end faces 112 and 123 which are perpendicular to the axial tool line 106, thereby enabling relative rotation of the upper section 110 and middle section 120 without affecting a magnitude of the bend angle. As shown, with respect to middle section 120 and lower section 130, end faces 122 and 132 have their direction of tilt aligned to maximize a tilt or bend angle caused in the steering device 100. That is, the end faces 122 and 132 have the slope of their respective tilts in opposite directions, which has the effect of compounding their relative tilts. This may be achieved by rotating the middle section 120 one-hundred eighty degrees relative to the upper section 110. Thus, the axial centerline 106 of the steering device 100 is generally angularly offset with the centerline 13 of the wellbore 12 and the drilling direction will generally follow the axial centerline 106, which will change the trajectory of the wellbore 12. In some embodiments, the amount of bend angle to be applied to the steering device 100 may be fixed. In other embodiments, the bend angle may be adjustable. That is, an offset between zero and one hundred eighty degrees will produce a proportionately smaller tilt or bend angle in the steering device 100.

As should be appreciated, the relative rotation between the middle section 120 and the lower section 130 controls the magnitude of a change in drilling direction relative to a long axis 13 of the wellbore. The relative rotation between the upper section 110 and the middle section 120, on the other hand, controls the direction for drilling.

In FIG. 1C, the drilling direction is shown in what may be considered a wellbore highside direction. This drilling direction may be changed or adjusted by rotating the middle section 120 relative to the upper section 110. Referring to FIG. 1C, the end faces 122 and 132 still have their direction of tilt aligned to maximize a tilt or bend angle caused in the steering device 100. However, the middle section 120 has been rotated one-hundred eighty degrees relative to the upper section 110. The drilling direction will still generally follow the axial centerline 106 to change the trajectory of the wellbore 12. However, the azimuthal drilling direction is now the wellbore lowside direction, or one hundred eighty degrees offset from the direction shown in FIG. 1B. It should be appreciated that the relative rotation between the upper section 110 and the middle section 120 may be set at any value between zero and three hundred sixty degrees to drill in a desired azimuthal direction.

Figure 2:
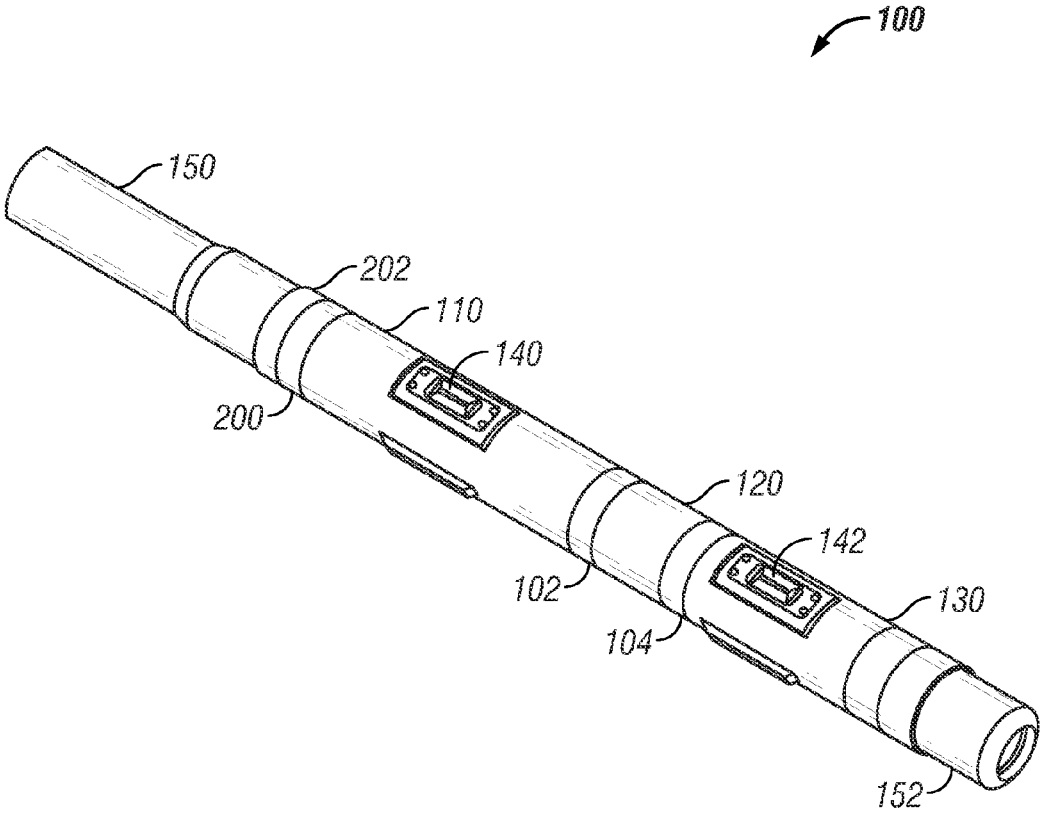
FIG. 2 isometrically illustrates elements of a steering device made in accordance with one embodiment of the present disclosure.

Referring now to FIG. 2, there is shown the steering device 100 in greater detail. As described previously, the steering unit 100 may include an upper section 110, a middle section 120 and a lower section 130. The pivot bearing 102 provides a rotational interface between the upper section 110 and the middle section 120 and the pivot bearing 104 provides a rotational interface between the middle section 120 and the lower section 130. The upper section 110 may include adjustable pads 140 that are circumferentially arranged along its outer circumference. The lower section 130 may also include pads 142. An upper drive shaft 150 may be configured to connect with a drill string (not shown) and a lower drive shaft 152 may be configured to connect with and rotate a drill bit (not shown).

In embodiments, the pads 140, 142 may be configured to extend and engage a wall of the wellbore to maintain the upper section 110 and/or the lower section 130 stationary relative to the wellbore. In one arrangement, the pad 140 may be formed as ribs that pivot or rotate into engagement with the wellbore wall 15 (FIG. 1A) to generate and/or support the steering force. In other embodiments, the pad 140 may be formed as a piston or pad that extends or retracts in a radial direction. Suitable actuating devices for the pads 140 may include hydraulic actuators, electric motors, and electro-mechanical linkages. The pads 140 may be independently adjustable or may move in unison. While three pads 140 may be utilized in many applications, some applications may require a greater or a fewer number of pads 140. Generally speaking, the pads 140 and 142 are merely illustrative of any number of anchoring members that may be suitable. Other anchoring members may include inflatable packers, slips, etc.

Figure 3:
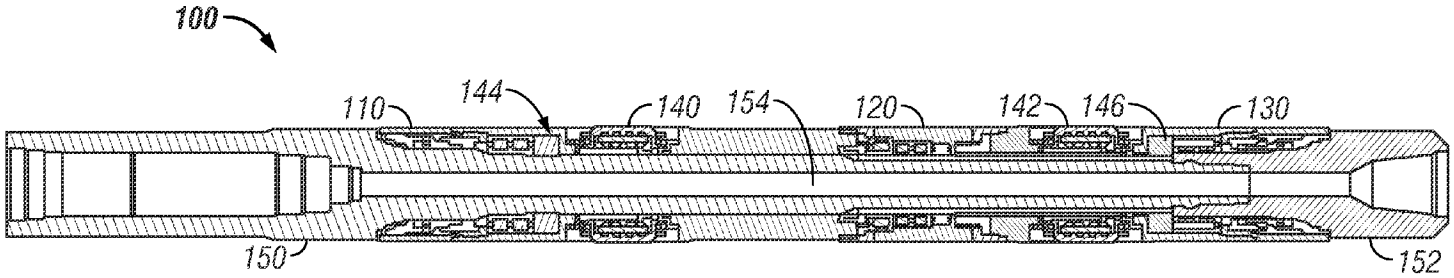
FIG. 3 schematically illustrates a sectional view of a portion of a steering device made in accordance with one embodiment of the present disclosure.

Referring now to FIG. 3, there is sectionally shown the steering device 100 illustrated in FIG. 2. The steering device 100 surrounds and is supported by the upper drive shaft 150 and the lower drive shaft 152. The upper drive shaft 150 and the lower drive shaft 152 include a bore 154 through which pressurized drilling mud pumped from the surface is conveyed to the drill bit (not shown). The upper section 110 is shown with illustrative pads 140 and a power unit 144, such as a hydraulic actuator, electrical actuator, etc. Similarly, the lower section 130 is shown with illustrative pads 142 that a power unit 146, such as a hydraulic actuator, an electrical actuator, etc. The pads may be independently actuated to engage the well wall 15. The steering device 100 may include thrust bearings (not shown) and journal bearings (not shown) and other suitable elements that allow the upper drive shaft 150 and the lower drive shaft 152 to rotate when the steering device 100 is anchored to the wellbore wall via the pads 140 and/or 142.

Figure 4:
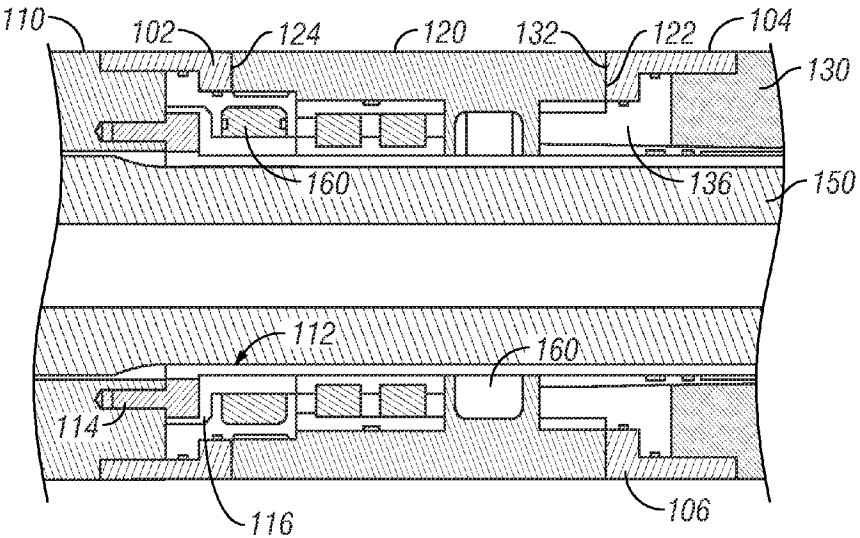
FIG. 4 schematically illustrates a sectional view of a more detailed portion of a steering device made in accordance with one embodiment of the present disclosure.

Referring now to FIG. 4, there is sectionally shown the middle section 120 in greater detail. In one arrangement, the middle section 120 has a face 122 that engages the lower section 130 via the pivot bearing 104, and a face 124 that engages the upper section 110 via the pivot bearing 102. A face 106 of the pivot bearing 104 includes an incline that is complementary to an incline of the middle section face 122. By inclined, it is meant that the surfaces of the face 122 and 106 are not perpendicular to an axial tool line. In embodiments, the space between seals (not shown) in FIG. 4 may be pressurized in order to lock the pivot bearings 102, 104.

In embodiments, the rotation of the upper drive shaft 150 may be utilized to selectively rotate several components of the steering device 100. For example, the steering device 100 may include a hydraulic locking or clamping device 136 that selectively rotates the middle section 120 relative to the upper section 110 as well as selectively rotating the middle section 120 relative to the lower section 130. When actuated, the hydraulic clamping device 136 may engage and rotate with the upper drive shaft 150. Thus, the pivot bearing 104 and lower section 130, for example, may rotate one-hundred eighty degrees relative to the middle section 120 when the hydraulic clamping device 136 is engaged. Also, the steering device 100 may include a reverse spinning sleeve 121 that may be used to rotate the middle section 120 in a direction counter to the rotation of the upper drive shaft 150. In one arrangement, the reverse spinning sleeve 121 may include a pinion 114 disposed on the upper section 110 that engages a gear 116 disposed on the middle section 120. The rotation of the upper drive shaft 150, therefore is converted into a counter-rotation of the reverse spinning sleeve 121. Brake elements 160, 161 may be disposed in the middle section 120 to prevent or allow rotation in a selected rotational direction (e.g., clockwise or counter clockwise). These brake elements 160, 161 may be used to control, adjust or change tool face direction and/or tilt angle by selectively engaging the middle section 120 with the drive shaft 150 in a manner described below.

Referring still to FIG. 4, it should be appreciated that the combined steering device 100 provides a relative movement between its sections 110, 120, 130 and the upper drive shaft 150. In embodiments, the reverse spinning sleeve 121 is positioned between the middle section 120 and the drive shaft 150. The reverse spinning sleeve 121 is configured to rotate in a direction opposition of the rotation of the drive shaft 150 as previously described. In an exemplary mode of operation, to turn the middle section 120 anticlockwise, the brake pad 160 is actuated to increase the friction between the middle section 120 and the reverse spinning sleeve 121. Thus, the middle section 120 rotates with the reverse spinning sleeve 121. In another exemplary mode of operation, to turn the middle section 120 clockwise, the brake 161 is actuated to apply friction to the drive shaft 150. Thus, the middle section 120 rotates with the drive shaft 150 in a clockwise direction. Suitable stops or bumpers may be used to control the stopping positions for the middle section 120. It should be appreciated that the brake elements 160, 161 need not lock the middle section 120 with either the reverse spinning sleeve 121 or the drive shaft 150. The brake elements 160, 161 may be configured to provide sufficient friction to generate frictional forces of sufficient magnitude to cause the middle section 120 to rotate.

An exemplary mode for adjusting tool face may include actuating the pads 140 of the upper section 110 to engage a wellbore wall, actuating the pivot bearing 102 to allow free rotation between the upper section 110 and the middle section 120, and deactivating the pads 142 of the lower section 130 to disengage from the wellbore wall. Thereafter, the brake pads 160 or 161 may be activated to rotate the middle section 120 and the lower section 130.

An exemplary mode for adjusting tilt angle correction may include actuating the pads 140 of the upper section 110 to engage a wellbore wall, actuating the pivot bearings 102 and 104 to allow free rotation between the upper section 110 and the middle section 120 as well as the middle section 120 and the lower section 130, and activating the pads 142 of the lower section 130 to engage from the wellbore wall. Thereafter, the brake pads 160 or 161 may be activated to rotate the middle section 120 relative to the lower section 130 to increase or decrease the bend angle.

In another embodiment not shown, hydraulic power may be used to energize a suitable rotation device. For example, the hydraulic actuator 146 (FIG. 3) may supply pressurized hydraulic fluid to a piston cylinder arrangement. The displacement of the piston may be used to rotate the pivot bearing 104. Likewise, the hydraulic actuator 144 may supply pressurized hydraulic fluid to a piston cylinder arrangement that rotates the pivot bearing 102.

Referring now to FIG. 2, in embodiments, the steering device 100 may include electronics and other equipment that enable surface and/or closed-loop downhole control. In one arrangement, an electronics unit 200 may be positioned in the upper section 110 and include processing devices that may estimate the relative position and orientation of the elements forming the steering unit 100 based on sensor measurements. The sensors may be distributed along the steering device 100. Exemplary sensors for determining position or orientation parameters include rotational speed sensors (RPM), azimuth sensors, inclination sensors, gyroscopic sensors, magnetometers, and three-axis accelerometers. The electronics unit 200 may include a controller 202 that receives inputs such as sensor signals and command signals and operates the devices such as the hydraulic clamp 136 or the drive unit to obtain the desired position and orientation for the steering device 100.

Figure 5:
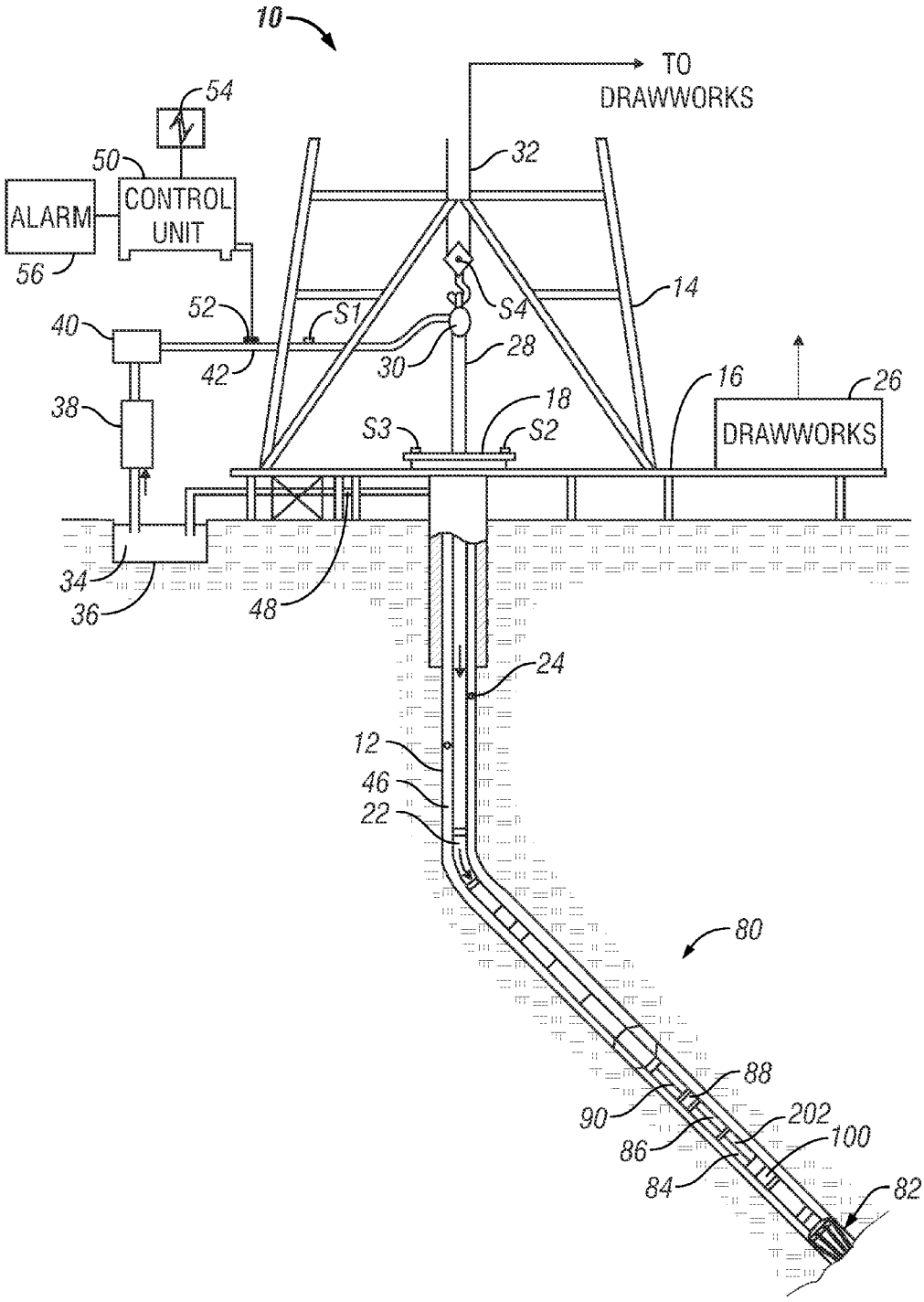
FIG. 5 schematically illustrates a drilling system using a steering device made in accordance with one embodiment of the present disclosure.

Referring now to FIG. 5, there is shown an embodiment of a drilling system 10 utilizing a steerable drilling assembly or bottomhole assembly (BHA) 80 made according to one embodiment of the present disclosure to directionally drill wellbores. While a land-based rig is shown, these concepts and the methods are equally applicable to offshore drilling systems. The system 10 shown in FIG. 5 has a drilling assembly 80 conveyed in a borehole 12. The drill string 22 includes a jointed tubular string 24, which may be drill pipe or coiled tubing, extending downward from a rig 14 into the borehole 12. The drill bit 82, attached to the drill string end, disintegrates the geological formations when it is rotated to drill the borehole 12. The drill string 22, which may be jointed tubulars or coiled tubing, may include power and/or data conductors such as wires for providing bidirectional communication and power transmission. The drill string 22 is coupled to a draw works 26 via a kelly joint 28, swivel 30 and line 32 through a pulley (not shown). The operation of the drawworks 26 is well known in the art and is thus not described in detail herein.

During drilling operations, a suitable drilling fluid 34 from a mud pit (source) 36 is circulated under pressure through a channel in the drill string 22 by a mud pump 34. The drilling fluid passes from the mud pump 38 into the drill string 22 via a desurger 40, fluid line 42 and Kelly joint 28. The drilling fluid 34 is discharged at the borehole bottom through an opening in the drill bit 82. The drilling fluid 34 circulates uphole through the annular space 46 between the drill string 22 and the borehole 12 and returns to the mud pit 36 via a return line 48. The drilling fluid acts to lubricate the drill bit 82 and to carry borehole cutting or chips away from the drill bit 82. A sensor $S_1$ typically placed in the line 42 provides information about the fluid flow rate. A surface torque sensor $S_2$ and a sensor $S_3$ associated with the drill string 22 respectively provide information about the torque and rotational speed of the drill string 22. Additionally, sensor $S_4$ associated with line 29 is used to provide the hook load of the drill string 22.

A surface controller 50 receives signals from the downhole sensors and devices via a sensor 52 placed in the fluid line 42 and signals from sensors $S_1$, $S_2$, $S_3$, hook load sensor $S_4$ and any other sensors used in the system and processes such signals according to programmed instructions provided to the surface controller 50. The surface controller 50 displays desired drilling parameters and other information on a display/monitor 54 and is utilized by an operator to control the drilling operations. The surface controller 50 contains a computer, memory for storing data, recorder for recording data and other peripherals. The surface controller 50 processes data according to programmed instructions and responds to user commands entered through a suitable device, such as a keyboard or a touch screen. The controller 50 is preferably adapted to activate alarms 56 when certain unsafe or undesirable operating conditions occur.

Still referring to FIG. 5, the sensor sub 86 may include sensors for measuring near-bit direction (e.g., BHA azimuth and inclination, BHA coordinates, etc.), dual rotary azimuthal gamma ray, bore and annular pressure (flow-on & flow-off), temperature, vibration/dynamics, multiple propagation resistivity, and sensors and tools for making rotary directional surveys. The formation evaluation sub 90 may includes sensors for determining parameters of interest relating to the formation, borehole, geophysical characteristics, borehole fluids and boundary conditions. These sensor include formation evaluation sensors (e.g., resistivity, dielectric constant, water saturation, porosity, density and permeability), sensors for measuring borehole parameters (e.g., borehole size, and borehole roughness), sensors for measuring geophysical parameters (e.g., acoustic velocity and acoustic travel time), sensors for measuring borehole fluid parameters (e.g., viscosity, density, clarity, rheology, pH level, and gas, oil and water contents), and boundary condition sensors, sensors for measuring physical and chemical properties of the borehole fluid.

The subs 86 and 90 may include one or memory modules, and a battery pack module to store and provide back-up electric power may be placed at any suitable location in the BHA 80. Additional modules and sensors may be provided depending upon the specific drilling requirements. Such exemplary sensors may include an rpm sensor, a weight on bit sensor, sensors for measuring mud motor parameters (e.g., mud motor stator temperature, differential pressure across a mud motor, and fluid flow rate through a mud motor), and sensors for measuring vibration, whirl, radial displacement, stick-slip, torque, shock, vibration, strain, stress, bending moment, bit bounce, axial thrust, friction and radial thrust. The near bit inclination devices may include three (3) axis accelerometers, gyroscopic devices and signal processing circuitry as generally known in the art. These sensors may be positioned in the subs 86 and 90, distributed along the drill pipe, in the drill bit and along the BHA 80. Further, while subs 86 and 90 are described as separate modules, in certain embodiments, the sensors above described may be consolidated into a single sub or separated into three or more subs. The term "sub" refers merely to any supporting housing or structure and is not intended to mean a particular tool or configuration.

Processor 202 processes the data collected by the sensor sub 86 and formation evaluation sub 90 and transmit appropriate control signals to the steering device 100. The processor 202 may be configured to decimate data, digitize data, and include suitable PLC's. For example, the processor may include one or more microprocessors that uses a computer program implemented on a suitable machine-readable medium that enables the processor to perform the control and processing. The machine-readable medium may include ROMs, EPROMs, EAROMs, Flash Memories and Optical disks. Other equipment such as power and data buses, power supplies, and the like will be apparent to one skilled in the art. The processor 202 may positioned in the sensor sub 86 or elsewhere in the BHA 80. Moreover, other electronics, such as electronics that drive or operate actuators for valves and other devices may also be positioned along the BHA 80.

The bidirectional data communication and power module ("BCPM") 88 transmits control signals between the BHA 80 and the surface as well as supplies electrical power to the BHA 80. For example, the BCPM 88 provides electrical power to the steering device 100 and establishes two-way data communication between the processor 202 and surface devices such as the controller 50. In one embodiment, the BCPM 88 generates power using a mud-driven alternator (not shown) and the data signals are generated by a mud pulser (not shown). The mud-driven power generation units (mud pursers) are known in the art and thus not described in greater detail. In addition to mud pulse telemetry, other suitable two-way communication links may use hard wires (e.g., electrical conductors, fiber optics), acoustic signals, EM or RF. Of course, if the drill string 22 includes data and/or power conductors (not shown), then power to the BHA 80 may be transmitted from the surface.

In one configuration, the BHA 80 includes a drill bit 82, a drilling motor 84, a sensor sub 86, a bidirectional communication and power module (BCPM) 88, and a formation evaluation (FE) sub 90. To enable power and/or data transfer to the other making up the BHA 80, the BHA 80 includes a power and/or data transmission line (not shown). The steering device 100 may be operated to steer the BHA 80 along a selected drilling direction by applying an appropriate tilt to the drill bit 82.

Referring now to FIGS. 1A-C and 4, in an exemplary manner of use, the BHA 80 is conveyed into the wellbore 12 from the rig 14. During drilling of the wellbore 12, the steering device 100 steers the drill bit 82 in a selected direction. The drilling direction may follow a preset trajectory that is programmed into a surface and/or downhole controller (e.g., controller 50 and/or controller 202). The controller(s) use directional data received from downhole directional sensors to determine the orientation of the BHA 80, compute course correction instructions if needed, and transmit those instructions to the steering device 100.

An exemplary mode of operation of the steering unit 100 will now be described. As an arbitrary starting point, the drill string 22 may be drilling the wellbore without curvature, e.g., drilling a straight wellbore. In such a condition, the pivot bearing 104 is operated to set the face 132 of the lower section 130 in a position that cancels the tilt of the face of the middle section 120.

To initiate directional drilling, a drilling direction is first selected. This may be performed by first determining the directional information such as azimuth and inclination from the directional sensor on-board the BHA 80. The drilling direction may be selected by a downhole controller and/or by personnel at the surface. Thereafter, a downhole controller and/or personnel at the surface may determine the azimuthal orientation and the amount of tilt required to steer the drill string 22 in the selected direction. Thereafter, one or more controllers may determine the current angular or rotational positions of the pivot bearings 102 and 104. Once the relative angular positions have been determined, the control unit 200 may operate the hydraulic clamp 136 to shift the pivot bearing 104 into a one-hundred eighty degree offset relative to the face 122 of the middle section 120. Next, the control unit 200 actuates the gear unit 116 to rotate the middle section 120 into a rotational alignment with the upper section 110 to obtain the necessary azimuthal direction.

The relative alignment or position of the steering unit 100 and related components may be periodically or continually monitored by the control unit 200 or other downhole processors. The control unit 200 or other downhole processors may adjust the steering unit 100 to account for any variations or discrepancies that may arise to thereby maintain the desired drilling direction. Similarly, if the direction of drilling requires change, the control unit 200 may operate the gear unit to set the desired azimuthal direction or actuate the hydraulic clamp to remove the tilt to the drill bit.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

What is claimed is:

1. An apparatus configured to be conveyed in a wellbore via a drill string, comprising:

a first section;

a second section coupled to the first section, wherein the second section is configured to be selectively rotated relative to the first section; and a third section rotatably coupled to the second section, wherein the second section and the third section are configured to rotate relative to each other to control a bend angle in the drill string;

a drive shaft through the second section; and a brake element configured to engage the second section to the drive shaft to rotate the second section relative to the third section to control the bend angle in the drill string.

2. The apparatus of claim 1 wherein the first section, the second section and the third section are sleeves configured to surround a portion of the drill string.

3. The apparatus of claim 1 wherein the first section includes at least one anchoring element configured to anchor the first section to a wall of the wellbore.

4. The apparatus of claim 1, further comprising a drive unit configured to rotate the second section relative to the first section.

5. The apparatus of claim 1, further comprising a clamping device configured to selectively rotate one of the first section and the third section relative to the second section.

6. The apparatus of claim 5, wherein the clamping device is configured to engage and rotate with the drive shaft.

7. The apparatus of claim 6, further comprising a spinning sleeve configured to rotate the second section in a direction counter to a rotation of the drive shaft.

8. The apparatus of claim 1, wherein the brake element is further configured to control rotation of the second section in a selected direction.

9. The apparatus of claim 1 wherein the brake element is further configured to selectively engage the second section to the drive shaft to control a tool face direction.

10. The apparatus according to claim 1, further comprising a pivot bearing connecting one of: (i) the first section to the second section, and (ii) the second section to the third section, wherein the pivot bearing is configured to selectively lock adjoining sections.

11. The apparatus of claim 1 wherein the first section, the second section and the third section are configured to be rotatably mounted on the drill string.

12. A method for forming a wellbore in an earth formation, comprising:

positioning a first section, a second section, and a third section on a drill string;

rotatably coupling the first section to the second section and the second section to the third section to provide a drive shaft through the second section;

conveying the drill string into the wellbore; and engaging the second section to the drive shaft to rotate the second section relative to the third section to control a bend angle in the drill string; and forming the wellbore using the drill string having the bend angle.

13. The method of claim 12 wherein the first section, the second section and the third section are configured as sleeves that surround a portion of the drill string.

14. The method of claim 12, further comprising locking the first section to a wall of the wellbore.

15. The method of claim 12, further comprising locking the third section to a wall of the wellbore.

16. The method of claim 12, further comprising using a clamping device to rotate the third section relative to the second section.

17. A system for forming a wellbore in an earth formation, comprising:

a drill string;

a first section, a second section coupled to the first section, wherein the second section is configured to be selectively rotated relative to the first section, and a third section rotatably coupled to the second section, wherein the second section and the third section are configured to rotate relative to each other;

a drive shaft through the second section; and a brake element configured to engage the second section to the drive shaft to rotate the second section relative to the third section to control a bend angle in the drill string.

18. The apparatus of claim 17, further comprising a drive unit configured to rotate the second section relative to the first section.

19. The apparatus of claim 17, further comprising a clamping device configured to selectively rotate one of the first section and the third section relative to the second section.

20. The apparatus of claim 17, wherein the brake element is configured to control rotation of the second section in a selected direction.

21. The system of claim 17, further comprising a control unit configured to control rotation of the second section relative to the third section.

* * * * *